US005905482A

United States Patent [19]

Hughes et al.

[11] Patent Number: 5,905,482

[45] Date of Patent: May 18, 1999

[54] FERROELECTRIC LIQUID CRYSTAL DISPLAYS WITH DIGITAL GREYSCALE

[75] Inventors: Jonathan Rennie Hughes; Alastair Graham, both of Malvern; Michael John Towler; Edward Peter Raynes, both of Oxford, all of United Kingdom

[73] Assignee: The Secretary of State for Defence in Her Britannic Majesty's Government of the United Kingdom of Great Britain and Northern Ireland, Hants, United Kingdom

[21] Appl. No.: 08/722,062

[22] PCT Filed: Apr. 10, 1995

[86] PCT No.: PCT/GB95/00814

§ 371 Date: Oct. 29, 1996

§ 102(e) Date: Oct. 29, 1996

[87] PCT Pub. No.: WO95/27971

PCT Pub. Date: Oct. 19, 1995

[30] Foreign Application Priority Data

Apr. 11, 1994 [GB] United Kingdom ..... 9407116

[51] Int. Cl.[6] ..... G09G 3/36

[52] U.S. Cl. ..... 345/89; 345/97

[58] Field of Search ..... 345/87, 88, 89, 345/92, 94, 96, 97, 99; 349/33, 34, 36, 39, 42

[56] References Cited

U.S. PATENT DOCUMENTS

| | | | |
|---|---|---|---|
| 4,367,924 | 1/1983 | Clark et al. . | |
| 4,563,059 | 1/1986 | Clark et al. . | |
| 5,048,246 | 9/1991 | Inaba et al. | 345/89 |
| 5,398,042 | 3/1995 | Hughes | 345/94 |
| 5,469,281 | 11/1995 | Katakura et al. | 345/97 |
| 5,497,173 | 3/1996 | Hughes | 345/97 |

FOREIGN PATENT DOCUMENTS

| | | |
|---|---|---|
| 0 214 857 | 3/1987 | European Pat. Off. . |
| 0 261 901 | 3/1988 | European Pat. Off. . |
| A-306011 | 3/1989 | European Pat. Off. . |
| A-421712 | 4/1991 | European Pat. Off. . |
| 0 453 033 | 10/1991 | European Pat. Off. . |
| A-453033 | 10/1991 | European Pat. Off. . |

(List continued on next page.)

OTHER PUBLICATIONS

Clark, Noel A. et al., "Submicrosecond Bistable Electro–Optic Switching in Liquid Crystals", Appl. Phys. Lett. vol. 36, No. 11, Jun. 1, 1980, pp. 899–901.

(List continued on next page.)

*Primary Examiner*—Chanh Nguyen
*Attorney, Agent, or Firm*—Nixon & Vanderhye P.C.

[57] ABSTRACT

The invention provides a ferroelectric liquid crystal display with uniformly spaced greyscale levels. The invention uses a bistable ferroelectric liquid crystal display formed by a layer of chiral smectic liquid crystal material between two cell walls. The walls carry e.g. line and column electrodes to give an x,y matrix of addressable pixels, and are surface treated to provide bistable operation. Each pixel may be divided into subpixels thereby giving spatial weighting for greyscale. Temporal weighting of greyscale is obtained by switching a pixel to a dark state for time T1 and a light state for time T2. When T1 and T2 are not equal, four different greyscales are obtainable; i.e. dark, dark grey, light grey, and light. The present invention provides a required uniform spacing of greyscale levels by addressing each pixel two or more times in one frame time. Each pixel is blanked then strobed, two or more times in each frame time; the relative times between blanking and strobing, at least four different time periods, are varied to give the desired greyscale levels. The temporal and spatial weighting may be combined to increase the number of obtainable greyscales. Further, the relative intensity between adjacent subpixels may be adjusted to vary the apparent size of the smallest subpixel; this is useful when subpixel size is near to manufacturing limits.

8 Claims, 9 Drawing Sheets

FOREIGN PATENT DOCUMENTS

| | | |
|---|---|---|
| A-4022866 | 1/1991 | Germany . |
| A-2164776 | 3/1986 | United Kingdom . |
| 2 166 256 | 4/1986 | United Kingdom . |
| 2 173 336 | 10/1986 | United Kingdom . |
| 2 173 629 | 10/1986 | United Kingdom . |
| 2 209 610 | 7/1990 | United Kingdom . |
| 2 262 831 | 6/1993 | United Kingdom . |
| WO 89/05025 | 6/1989 | WIPO . |

OTHER PUBLICATIONS

Harada, T. et al., "An Application of Chiral Smectic–C Liquid Crystal to a Multiplexed Large–Area Display", SID 85 Digest, Paper 8.4, 1985, pp. 131–134.

Kuniyasu, Seiyu et al., "The Strength of Rubbing Worked on Polyimide Films . . . ", Japanese Journal of Applied Physics, vol. 27, No. 5, May, 1988, pp. 827–829.

Lagerwall, S.T. et al., "Ferroelectric Liquid Crystals for Displays", 1985 International Display Research Conference, pp. 213–221.

Le Pesant, J.P. et al., "Ferroelectric Optical Switching of Chiral Smectic C Liquid Crystal Mixtures", Proc. 4$^{th}$ IDRC, 1984, pp. 217–220.

Meyer, R.B. et al., "Ferroelectric Liquid Crystals", Le Journal De Physique–Lettres, Tome 36, Mar. 1975, pp. L–69–L–71.

Fig.6.

```
Line
      12345678  time periods
1     A-A-----
2     -A-A----
3     ----A-A-
4     -----A-A
```

Fig.8.

```
Line
      123456789012  time periods
1     A----A------
2     ----A----A--
3     -A------A---
4     --A----A----
5     ------A----A
6     ---A------A-
```

Fig.7.
| TIME | $1_1 \ldots 1_{60} 2_1 \ldots 1_{60} 3_1 \ldots 3_{60} 4_1 \ldots 4_{60} 5_1 \ldots 5_{60} 6_1 \ldots 6_{60} 7_1 \ldots 7_{60} 8_1 \ldots 8_{60}$ |
|---|---|
| LINE | |
| 1 + 4q | A A |
| 2 + 4q | A A |
| 3 + 4q | A A |
| 4 + 4q | A A |
Fig.14.
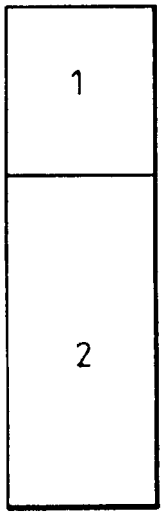
Fig.15.
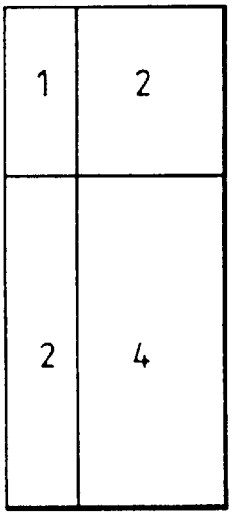
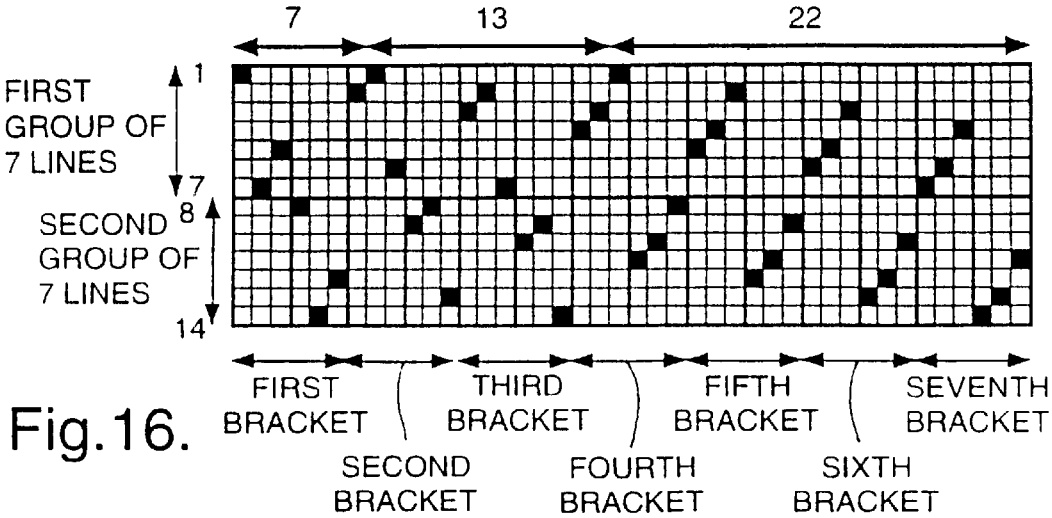
Fig.16.

```
Line
-123456789012345678901234567890 12   Time
1S------bS-------------b---------
2-S------bS-------------b--------
3--S------bS-------------b-------
4---S------bS-------------b------
5----S------bS-------------b-----
6-----S------bS-------------b----
7------S------bS-------------b---
8-------S------bS-------------b--
9------b---------S------bS-------
0-------b---------S------bS------
1--------b---------S------bS-----
2---------b---------S------bS----
3----------b---------S------bS---
4-----------b---------S------bS--
5------------b---------S------bS-
6-------------b---------S------bS
```

Fig.10.

```
Line
-123456789012345678901234567890 12 Time
1S-------------------bS---------b
2-bS-------------------bS--------
3---bS-------------------bS------
4-----bS-------------------bS----
5-------bS-------------------bS--
6---------bS-------------------bS
7bS---------bS-------------------
8--bS---------bS-----------------
9----bS---------bS---------------
0------bS---------bS-------------
1--------bS---------bS-----------
2----------bS---------bS---------
3------------bS---------bS-------
4--------------bS---------bS-----
5----------------bS---------bS---
6------------------bS---------bS-
```

Fig.11.

```
Line
-123456789012345678901234567890 12 Time
1S-------------b------S------b---
2--S-------------b------S------b-
3b---S-------------b------S------
4--b---S-------------b------S----
5----b---S-------------b------S--
6------b---S-------------b------S
7-S------b---S-------------S-----
8---S------b---S-------------b---
9-----S------b---S-------------b-
0b------S------b---S-------------
1--b------S------b---S-----------
2----b------S------b---S---------
3------b------S------b---S-------
4--------b------S------b---S-----
5----------b------S------b---S---
6------------b------S------b---S-
```

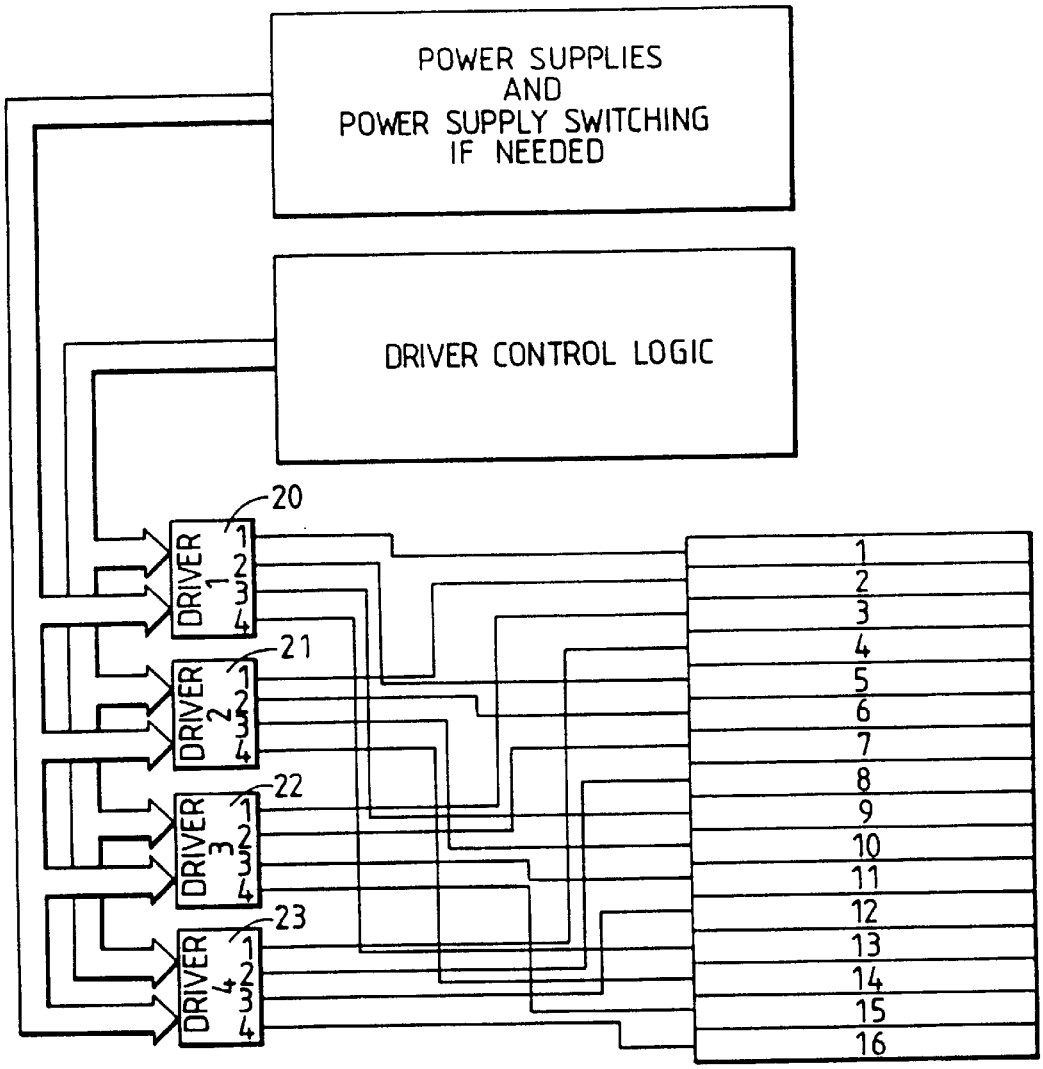

Fig.13.

DRIVERS 1 - 4 ARE TYPICAL 32 OR 64 OUTPUT LCD COLUMN DRIVERS (eg.HV77).
IT MAY BE NECESSARY TO USE A POWER SUPPLY SWITCHING TECHNIQUE TO OBTAIN THE THREE VOLTAGE LEVEL OUTPUTS.
THIS 16 ROW DISPLAY CAN BE CASCADED TO USE ALL OF THE AVAILABLE DRIVER OUTPUTS(eg. IF HV77'S ARE USED, A 256 ROW DISPLAY WILL ONLY USE 4 ROW DRIVERS.)
LARGER DISPLAYS CAN BE DRIVEN BY INCREASING THE NUMBER OF DRIVERS IN THE CYCLE, OR CASCADING GROUPS OF 4 DRIVERS TOGETHER.

FERROELECTRIC LIQUID CRYSTAL DISPLAYS WITH DIGITAL GREYSCALE

BACKGROUND OF THE INVENTION

1. Field of the Invention

This invention relates to the multiplex addressing of bistable liquid crystal displays with greyscale, particularly ferroelectric liquid crystal displays.

2. Discussion of Prior Art

Liquid crystal display devices are well known. They typically comprise a liquid crystal cell formed by a thin layer of a liquid crystal material held between two glass walls. These walls carry transparent electrodes which apply an electric field across the liquid crystal layer to cause a reorientation of the molecules of liquid crystal material. The liquid crystal molecules in many displays adopt one of two states of molecular arrangement. Information is displayed by areas of liquid crystal material in one state contrasting with areas in the other state. One known display is formed as a matrix of pixels or display elements produced at the intersections between column electrodes on one wall and line (or row) electrodes on the other wall. The display is often addressed in a multiplex manner by applying voltages to successive line and column electrodes.

Liquid crystal materials are of three basic types, nematic, cholesteric, and smectic each having a distinctive molecular arrangement.

The present invention concerns ferroelectric smectic liquid crystal materials. Devices using this material form the surface stabilised ferroelectric liquid crystal (SSFLC) device. These devices can show bistability, ie the liquid crystal molecules, more correctly the molecular director, adopt one of two aligned states on switching by positive and negative voltage pulses and remain in the switched state after removal of the voltage. The two states can appear as dark (black) and light (white) areas on a display. This bistable behaviour depends upon the surface alignment properties and chirality of the material.

A characteristic of SSFLCs is that they switch on receipt of a pulse of suitable voltage amplitude and length of time of application, ie pulse width, termed a voltage time product V.t. Thus both amplitude and pulse width need to be considered in designing multiplex addressing schemes.

There are a number of known systems for multiplex addressing ferroelectric displays: see for example article by Harada et al 1985 S.I.D. Paper 8.4 pp 131–134, and Lagerwall et al 1985 I.D.R.C. pp 213–221. See also GB 2,173,336-A, and GB 2,173,629-A. Multiplex addressing schemes for SSFLCs employ a strobe waveform that is applied in sequence to lines but not necessarily to successive lines simultaneously with data waveforms applied to eg column electrodes.

There are two basic types of addressing. One uses two fields of addressing with a first strobe (eg positive strobe) in a first field, followed by a second strobe (eg negative strobe) in a second field; the two fields making up a frame which is the time taken to completely address a display. The other type of addressing uses a blanking pulse to switch all pixels in one or more lines to say a black state, followed by a single strobe pulse applied sequentially to each line for selectively switching pixels in that line to a white state. In this blanking addressing system the frame time is the time required to blank plus the time taken to strobe all the lines.

The bistability property, together with the fast switching speed, makes SSFLC devices suitable for large displays with a large number of pixels or display elements. Such ferroelectric displays are described for example in;- N. A. Clark and S. T. Lagerwall. Applied Physics Letters Vol 36. No 11 pp 889–901. Jun. 1980; GB-2.166.256-A; U.S. Pat. No. 4,367,924; U.S. Pat. No. 4,563,059; patent GB-2,209,610; R. B. Meyer et al. J Phys Lett 36, L69, 1975.

For many displays two visible states only are required, ie an ON state and an OFF state. Examples of such displays include alpha numeric displays and line diagrams. There is now an increasing requirement for a plurality of visible states between the ON and OFF states, ie a plurality of different contrast levels. Such different levels are termed greyscales. Ideally the number of greyscales should be around 256 for good quality pictures, but worthwhile displays can be achieved with much lower values, eg 16 or less.

There are two known techniques for providing greyscale; temporal, and spacial dither. Temporal dither involves switching a pixel to black for a fraction of a frame time and white for the remainder. Providing the switching speed is above a flicker threshold (eg above about 35 Hz), a user's eye integrates over a period of time and sees an intermediate grey whose value depends upon the ratio of black to white time. Spatial dither involves dividing each pixel into individually switchable subpixels which may be of different size; each subpixel is sufficiently small at normal viewing distances that subpixels can not be distinguished individually. Both temporal and spacial dither techniques can be combined to increase the number of greyscale levels in a display; see EP9000942, 0453033, W. Hartmann, J. van Haaren.

Patent specification EP-0,214,857 describes a ferroelectric liquid crystal display with greyscale. Greyscale display is achieved by addressing each line of display with three successive equal period frame times, applying a scanning voltage at the beginning of each frame and blanking once per frame at a different time position within the three frames (other specifications would describe these three frames as three fields making up a single frame time). This gives a display with three different time periods when the display can be in a light state; these together with an all dark state gives eight different levels of greyscale. One disadvantage with this arrangement is a low maximum light intensity from the display.

Patent specification EP-261,901 describes a ferroelectric liquid crystal display with greyscale. The time to address a complete display, namely a frame time, is divided into fields of different lengths, hence a pixel can be switched into a light or a dark state for a time approximately equal to the length of each field. Each line is completely addressed in one frame time. A line is addressed (switched to an ON or OFF state) at the start (for a particular line) of each field time. To obtain a binary increase in greyscale levels the length of each field would increase in binary manner. For any reasonable number of lines to be addressed it is not possible to increase the length of each field in the desired progression in order to achieve a desired separation between the different levels of greyscale.

Patent Specification GB-A-2164776 is similar to EP-261,901 in having different length field times within a frame time. Pixels can be either light or dark in each field time. Thus a total of six different levels of greyscale are obtainable from 3 different length field times.

Patent Specification EP-A--0306011 describes a driving method for matrix of column and row electrodes in a ferroelectric liquid crystal display. A frame time is divided into three unequal length field times. The driving method comprises: dividing, the column electrodes into K groups of column electrodes, defining the number Z of column electrode lines constituting each group of the column electrodes, rendering one frame period, selecting a predetermined one of the K groups of the column electrodes for a time width ZTo of each of the blocks so that each picture element on the selected one of the groups of the column electrodes can be set in one of the bright and dark memory states; and selecting a number of times not smaller than n the K groups of thecolumn electrodes during each one-frame period $T_F$ according to a predetermined sequence.

One problem with existing addressing systems is that of providing different greyscale levels that are suitably different in intensity, and with a high overall display brightness.

Even with a combination of temporal and special dither it is still difficult to provide a suitable spacing of greyscale levels.

SUMMARY OF THE INVENTION

The present invention overcomes the present limit of greyscale levels by varying the relative positions of blanking and addressing pulses used to address each line of a matrix display.

According to this invention a method of multiplex addressing a bistable liquid crystal display formed by the intersections of an m set of electrodes and an n set of electrodes across a layer of smectic liquid crystal material to provide an mxn matrix of addressable pixels comprises the steps of:

generating m and n waveforms for applying to the m, n electrodes, such -waveforms comprising voltage pulses of various dc amplitude and sign;

applying an m-waveform to each electrode in the m set of electrodes in a sequence whilst applying appropriate one of two n-waveforms to the n set of electrodes to address each pixel along a given m electrode into a required state;

Characterised by the steps of:

addressing each pixel a first time end a second or more times in a given frame time, the addressing being by application of a blanking waveform followed or preceded by a strobe waveform in combination with one of two data waveforms, the time between application of blanking and strobe being an addressing time; and varying the addressing time and relative times of addressing each pixel within the frame time to provide a uniform greyscale intensity interval between different greyscale levels.

The addressing may be by a first blanking and strobe, and a second or more blanking and strobe pulse in combination with two data waveforms.

Alternatively, two sets of strobe pulses may be used in combination with two data waveforms.

The pixels in a display may be complete pixels or pixels formed by combinations of two or more subpixels of the same or different sizes. The relative intensifies of adjacent subpixels may be the same or different. According to this invention a multiplex addressed liquid crystal display comprises.

a liquid crystal cell including a layer of ferroelectric smectic liquid crystal material contained between two walls, an m set of electrodes on one wall and an n set of electrodes on the other wall arranged to form collectively an m,n matrix of addressable pixels:

waveform generators for generating m and n waveforms comprising voltage pulses of various dc amplitude and sign in successive time slots (ts) and applying the waveforms to the m and n sets of electrodes through driver circuits;

means for controlling the application of m and n waveforms so that a desired display pattern is obtained;

characterised by:

means for addressing each pixel a first time and a second or more times in a given frame time, the addressing being by application of a blanking waveform followed or preceded by a strobe waveform in combination with one of two data waveforms, the time between application of blanking and strobe being an addressing time; and varying the addressing time and relative times of addressing each pixel within the frame time to provide a required greyscale intensity interval between different greyscale levels.

Temporal weighting can be changed by changing the number of time periods in a frame time and the position of the two addressing pulses in that frame time. However, there are practical difficulties in providing the desired ratios between the two or more possible different switched states (T1:T2) the temporal ratio. The temporal ratio can be changed from that provided by the relative positioning of addressing pulses within a frame time, by varying the positions of blanking pulses relative to the strobing pulses.

Additionally, each pixel may be divided into subpixels of different or similar area, and each subpixel addressed with different levels of greyscale.

To provide a subpixel of small dimensions, the relative greyscale levels between adjacent subpixels way be varied to change the apparent relative size of the adjacent pixels.

BRIEF DESCRIPTION OF DRAWINGS

One form of the invention will now be described, by way of example only, with reference to the accompanying drawings in which:

FIG. 6 is a diagram showing the address sequence for a four line display with a temporal weighting of 1:3;

FIG. 7 is an extension of FIG. 6 showing how a 240 line display may be addressed;

FIG. 8 is a diagram showing one arrangement for addressing a six line display with a temporal weighting of 5:7;

FIG. 10 is a diagram showing another arrangement of addressing sequence for a sixteen line display having a temporal weighting of 1:2 and maximum brightness level of 30/32;

FIG. 11 is a diagram shown a further arrangement of addressing sequence for a sixteen line display having a temporal weighting of 1:2 and a maximum brightness level of 21/32;

FIG. 13 is a modification of part of FIG. 1 showing a different arrangement of line driver circuits:

FIG. 14 is a view of one pixel divided into two subpixels in the ratio 1:2, and;

FIG. 15 is a view of one pixel divided into four subpixels in the ratio 1:2:2:4.

FIG. 16 is a diagram showing an arrangement of addressing sequence for a 14 lines display with temperal ratio of 1:1.86:3.14.

DESCRIPTION OF PREFERRED EMBODIMENTS

Figure 1:
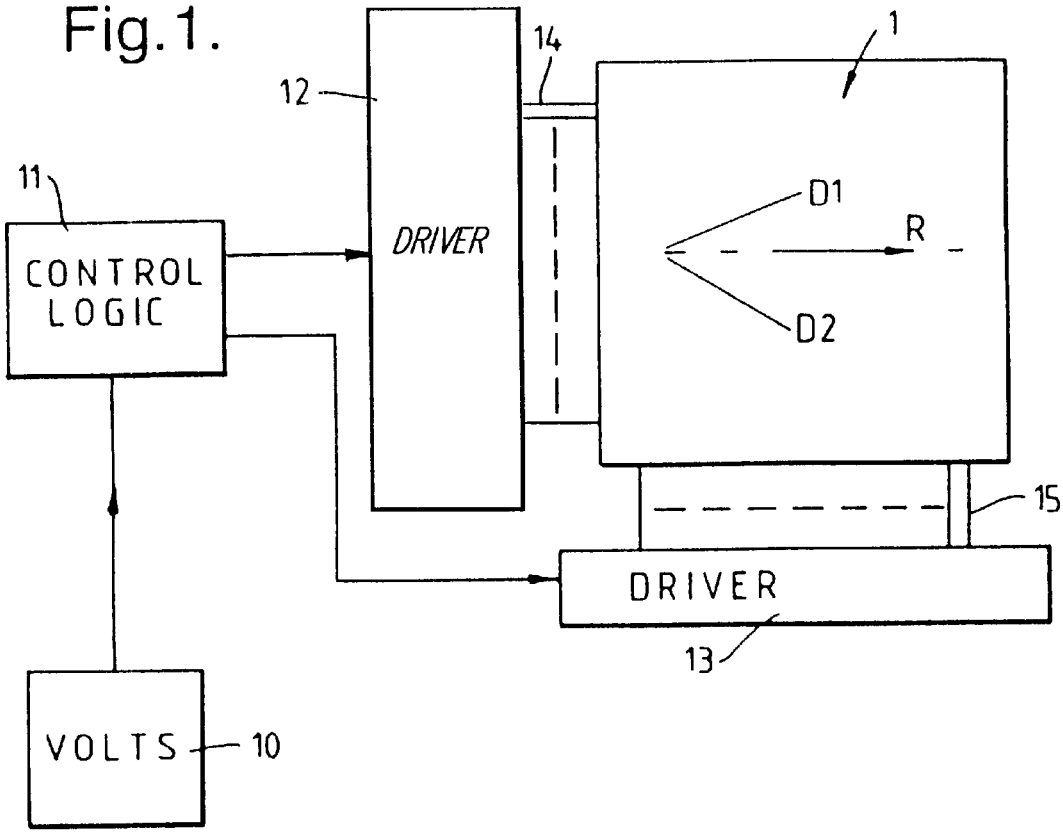
FIGS. 1, 2, are plan and section views of a liquid crystal display device.
Figure 2:
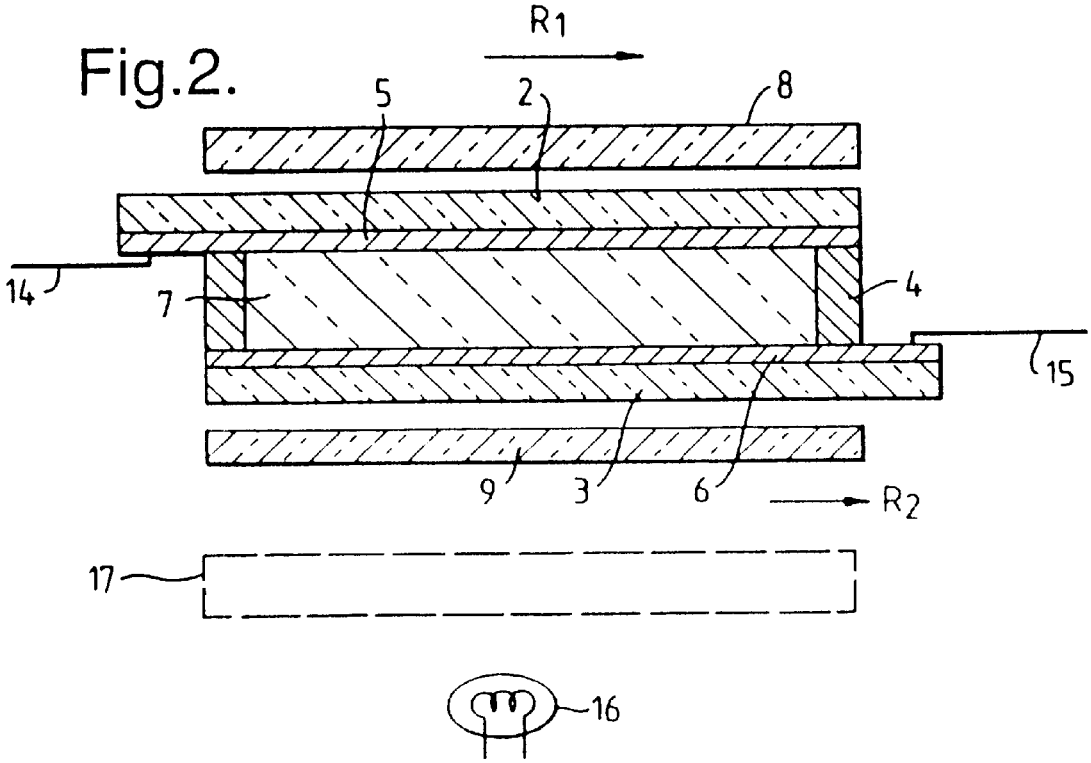

The cell 1 shown in FIGS. 1, 2 comprises two glass walls, 2, 3, spaced about 1–6 $\mu$m apart by a spacer ring 4 and/or distributed spacers. Electrode structures 5, 6 of transparent indium tin oxide are formed on the inner face of both walls. These electrodes may be of conventional line (x) and column (y) shape, seven segment, or an r-θ display. A layer 7 of liquid crystal material is contained between the walls 2, 3 and spacer ring 4. Polarisers 8, 9 are arranged in front of and behind the cell 1. The alignment of the optical axis of the polarisers 8, 9 are arranged to maximise contrast of the display; ie approximately crossed polarisers with one optical axis along one switched molecular direction. A d.c. voltage source 10 supplies power through control logic 11 to driver circuits 12, 13 connected to the electrode structures 5, 6, by wire leads 14, 15.

The device may operate in a transmissive or reflective mode, in the former light passing through the device e.g. from a tungsten bulb 16 is selectively transmitted or blocked to form the desired display. In the reflective mode a mirror 17 is placed behind the second polariser 9 to reflect ambient light back through the cell 1 and two polarisers. By making the mirror 17 partly reflecting the device may be operated both in a transmissive and reflective mode with one or two polarisers.

Prior to assembly the walls 2, 3 are surface treated eg by spinning on a thin layer of a polymer such as a polyamide or polyimide, drying and where appropriate curing; then buffing with a soft cloth (e.g. rayon) in a single direction R1, R2. This known treatment provides a surface alignment for liquid crystal molecules. The molecules (as measured in the nematic phase) align themselves along the rubbing direction R1, R2, and at an angle of about 0° to 15° to the surface depending upon the polymer used and its subsequent treatment; see article by S. Kuniyasu et al, Japanese J of Applied Physics vol 27, No 5, May 1988, pp827–829. Alternatively surface alignment may be provided by the known process of obliquely evaporating eg. silicon monoxide onto the cell walls.

Figure 3:
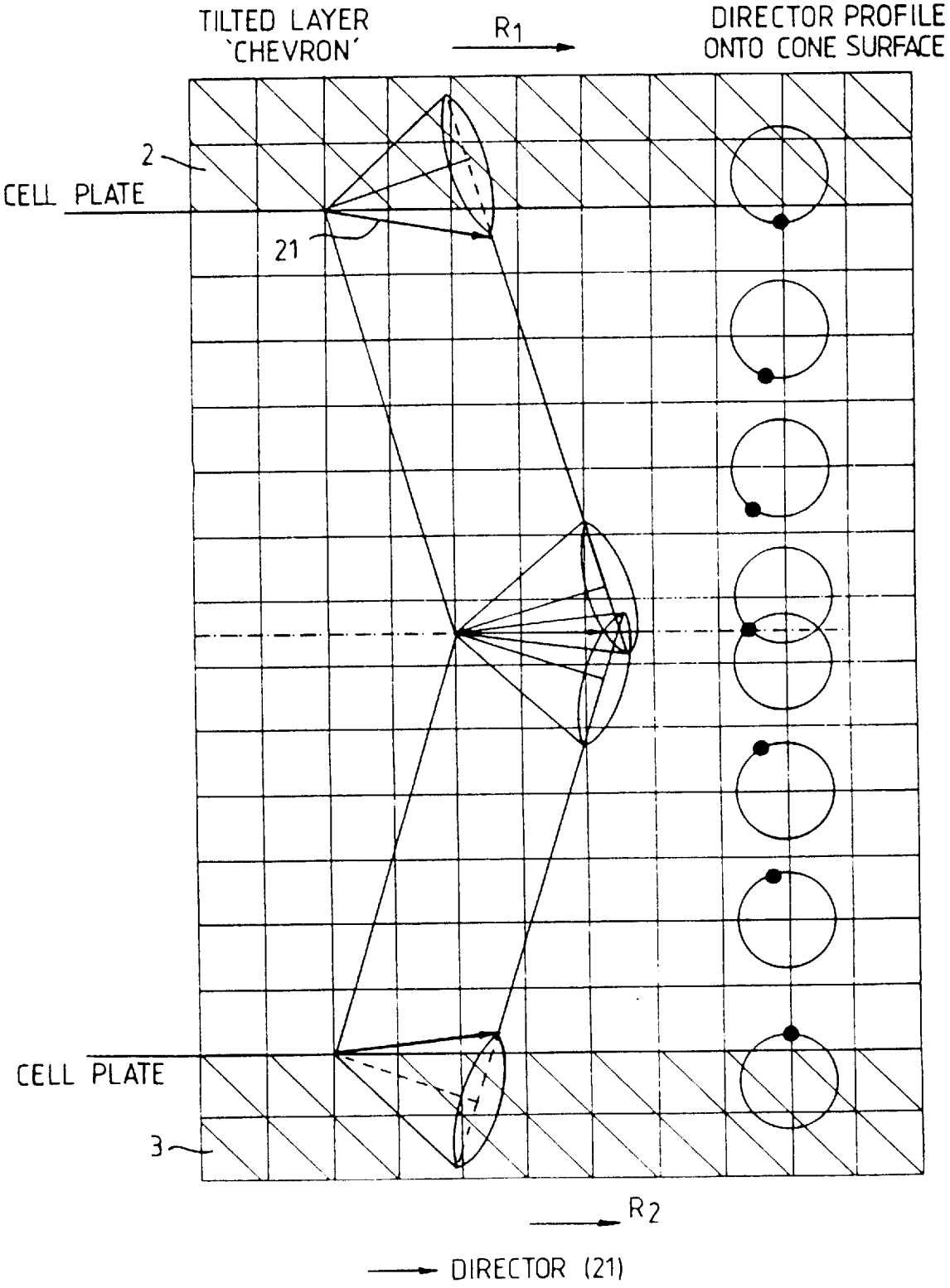
FIG. 3 is a stylised sectional view of part of FIG. 2 to a larger scale, showing one of several possible director profiles.

The surface alignment treatment provides an anchoring force to adjacent liquid crystal materials molecules. Between the cell walls the molecules are constrained by elastic forces characteristic of the material used. The material forms itself into molecular layers 20 each parallel to one another as shown in FIG. 3 which is a specific example of many possible structures. The Sc is a tilted phase in which the director lies at an angle to the layer normal, hence each molecular director 21 can be envisaged as tending to lie along the surface of a cone, with the position on the cone varying across the layer thickness, and each macro layer 20 often having a chevron appearance.

Considering the material adjacent the layer centre, the molecular director 21 lies approximately in the plane of the layer. Application of a dc voltage pulse of appropriate sign will move the director along the cone surface to the opposite side of the cone. The two positions D1, D2 on this cone surface represent two stable states of the liquid crystal director, ie the material will stay in either of these positions D1, D2 on removal of applied electric voltage.

In practical displays the director may move from these idealised positions. It is common practice to apply an ac bias to the material at all times when information is to be displayed. This ac bias has the effect of moving the director and can improve display appearance. The effect of ac bias is described for example in Proc 4th IDRC 1984 pp 217–220. Display addressing scheme using ac bias are described eg in GB patent application number 90.17316.2. PCT/GB 91/01263, J. R. Hughes and E. P. Raynes. The ac bias may be data waveforms applied to the column electrodes 15.

Figure 4:
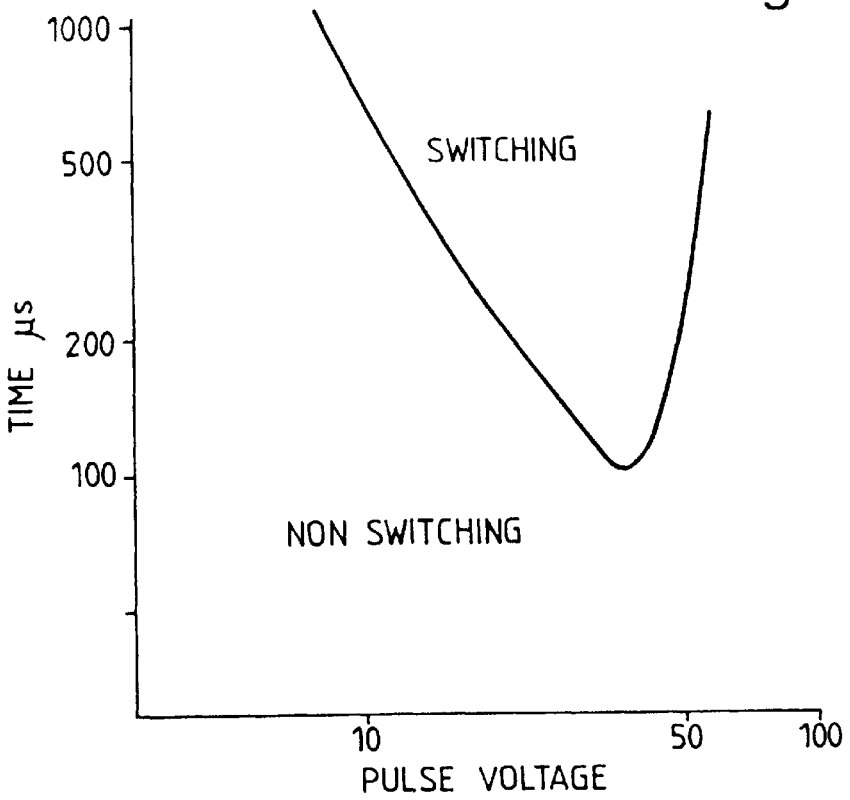
FIG. 4 is a graph showing switching characteristics of pulse width against pulse voltage for one liquid crystal material.

FIG. 4 shows the switching characteristics for the material SCE8. The curves mark the boundary between switching and nonswitching: switching will occur for a pulse voltage time product above the line. As shown the curve is obtained for an applied ac bias of 7.5 volts, measured at a frequency of 50 Hz. Suitable materials include catalogue references SCE8. ZLI-5014-000. available from Merck Ltd. those listed in PCT/GB88/01004, WO 89/05025, and:

19.6% CM8 (49% CC1 + 51% CC4) + 80.4% $H_1$

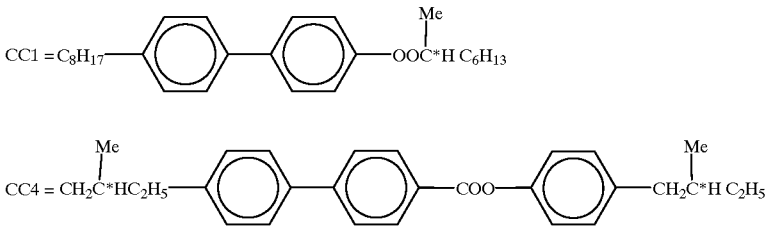

$H_1 = M_1 + M_2 + M_3$ (1:1:1)

-continued

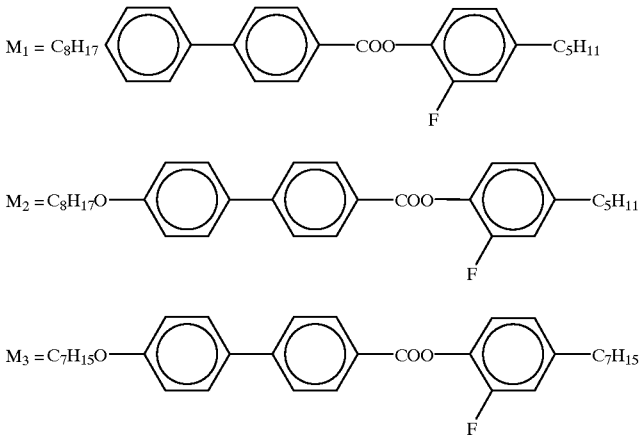

Another mixture is LPM 68=H1 (49.5%), As 100 (49.5%), IGS 97(1%) H1=MB 8.5F+MB 80.5F+MB 70.7F (1:1:1) AS100=PYR 7.09+PYR 9.09 (1:2)

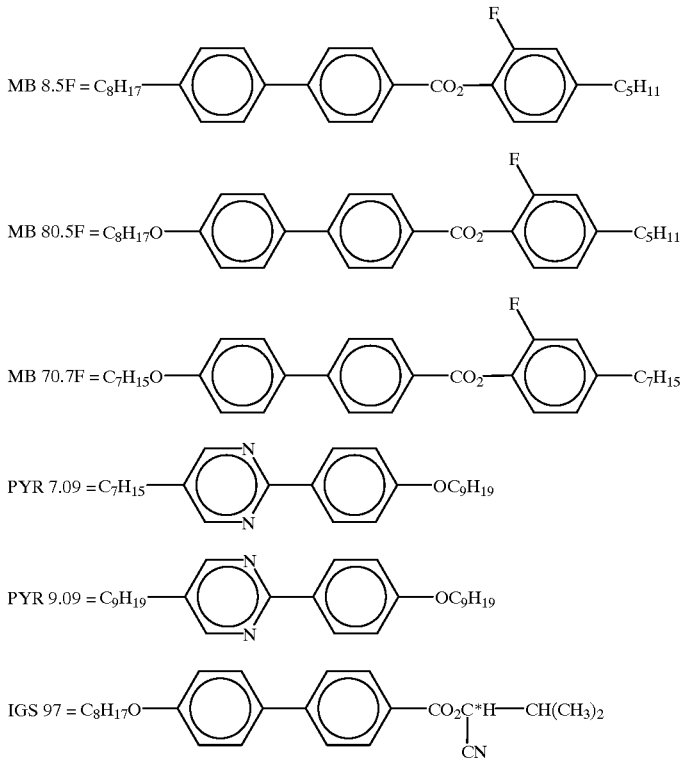

In one conventional display a (−) blanking pulse is applied to each line in turn; this causes all pixels in that line to switch to or remain black. Sometime later a strobe waveform is applied to each line in turn until all line are addressed. As each line receives a strobe, appropriate data-ON or data-OFF waveforms are applied to each column simultaneously. This means that each pixel in a line receives a resultant of strobe plus data-ON or strobe plus data-OFF. One of these resultants is arranged to switch a pixel to white, the other resultant leaves the pixel in the black state. Thus selected pixels in a line are turned from black to white, whilst other pixels remain black. The time taken to blank all lines then address all lines is a frame time. The blanking and strobing are repeatedly applied in sequence. To maintain net zero dc balance, the blanking pulses are dc balanced with the strobe pulses. Alternatively, all waveforms are regularly inverted in polarity.

This conventional type of display can only show two levels of greyscale, ie black and white.

Explanation of temporal weighting.

Although a given pixel can only adopt two switched states, namely a dark (eg black) and a light (eg white) appearance, four levels of greyscale can be provided by addressing each line twice per frame. To obtain the appearance of a contrast level between black and white (eg a grey), the pixel is repeatedly switched black for a time period T1 and switched white for a time period T2. Providing such a switching is above a flicker frequency of about 35 Hz, an operator will observe a contrast level or greyscale between black and white, eg grey. The darkness of the grey will depend upon the ratio of T1:T2. Providing T1 does not equal T2, then four different levels of intensity can be observed, ie four levels of greyscale. When the pixel is black for T1 and T2 the pixel is black; when the pixel is white for T1 and T2 the pixel is white. When T1>T2 then dark grey is obtained when the pixel is black for T1 and white for T2, and the pixel is light grey when the pixel is white for T1 and black for T2. In practice it is difficult to provide the desired ratio between the different levels of greyscale. Odd values of temporal ratios (T2:T4) are quite easy to produce, even values are required but are difficult to obtain.

Figure 5:
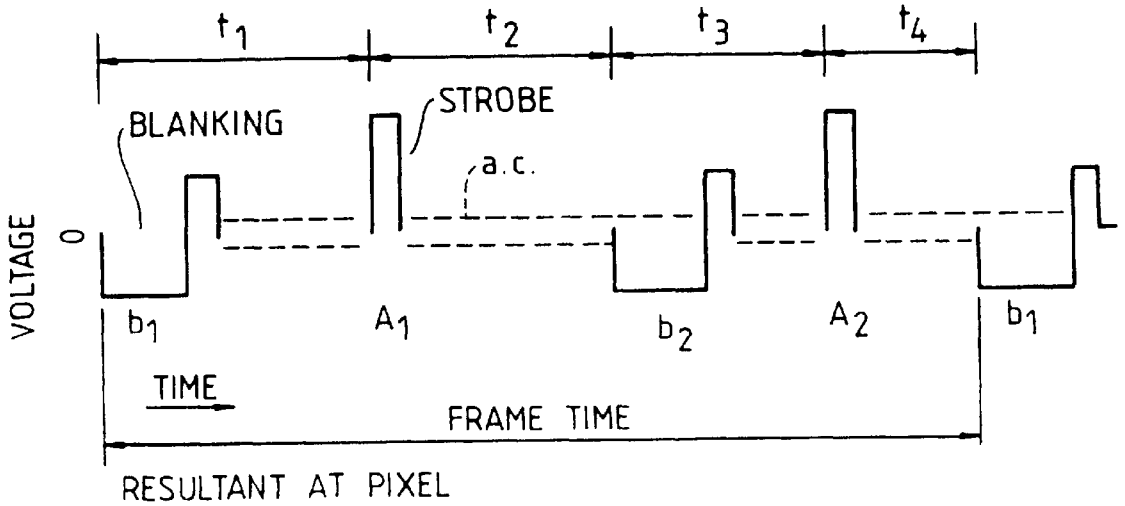
FIG. 5 is a diagrammatical representation of resultant voltages being applied to a pixel in one line of a display.

The principle of a uniform greyscale temporal addressing system is shown with reference to FIG. 5 which shows diagrammatically a resultant waveform at one pixel in a line being addressed.

As shown in FIG. 5 a pixel is switched to black by a blanking pulse Vb1. A time t1 later the pixel is addressed by a strobe pulse Va1. After a further period of t2 a blanking pulse Vb2 again switches the pixel to black. After a time of t3 a second strobe pulse Va2 addresses the pixel. After further time t4 the blanking pulse Vb1 is applied and the process repeated. The time between applications of the blanking pulse Vb1. ie t1+t2+t3+t4. is the frame time of a display. Both strobe pulses Va1 and Va2 are capable of switching a pixel to white or leaving it black.

This means that the pixel is always black for t1 and t3. The pixel can be either black or white for period t2, and either black or white for period t4. By varying the period t2 and t4, the pixel can have the appearance of any two greyscale levels between black and white as well as black and white. Varying t1 and t3 varies the overall display brightness.

The following table 1 shows different greyscales for addressing where t2>t4.

TABLE 1

| Period | t1 | t2 | t3 | t4 | Greyscale |
|---|---|---|---|---|---|
| State | black | white | black | white | (almost) white |
| State | black | white | black | black | light grey |
| State | black | black | black | white | dark grey |
| State | black | black | black | black | black |

FIG. 6 shows a display having four lines; the number of columns is immaterial. The number of line address time periods is eight. The letter A is used to show addressing of a pixel in a given line; this is diagrammatic only and presumes blanking and immediate strobing in one time slot. L1 is addressed in periods 1 and 3; L2 in periods 2 and 4; L3 in periods 5 and 7; L4 in periods 6 and 8. Thus a pixel can be say black for 2 time periods and white for 6 periods, ie a greyscale temporal weighting of 1:3. The greyscales are 0/8; 2/8; 6/8; 8/8, ie intervals of 1:3, and 3:4.

This can be extended to much larger displays by addressing the lines in groups, and dividing the time periods into sub periods, For example in FIG. 7 the lines are grouped as lines 1+4*q*, lines 2+4*q*, lines 3+4*q*, lines 4+4q where q is an integer, eg 1 to 60 giving a total of 240 lines. Each period is then divided into 60 subperiods. Line 1 is addressed in subperiod 1 of period 1: line 5 (1+4*q* q=1) is addressed in subperiod 2 of period 1; line 9 (1+4*q*, q=2) is addressed in subperiod 3 of period 1, etc until line 237 is addressed in subperiod 60 of period 1. Then line 2 is addressed in subperiod 1 of period 2, lines 6 . . . 238, lines 3, . . . 239, lines 4 . . . 240 etc. However, the greyscale temporal ratio is still 1:3 which does not give a linear spacing of the greyscale levels.

FIG. 8 shows the addressing of a six line display in a total of twelve time periods. Line L1 is addressed in periods 1 and 6, other lines are addressed as indicated. The position of the addressing pulse appears to move around in a non ordered manner. The reason for this is the double requirement of addressing each line twice in each frame time, and not being able to address two different lines at the same time. The illustrated 12 periods is only a snap-shot in time: the 12 periods repeat whilst the display is in operation. Each pixel can be in say a black state for 5 time periods and a white state for 7 time periods. The greyscale weighting is 5:7 which is still not a linear spacing of greyscale levels.

Figure 9:
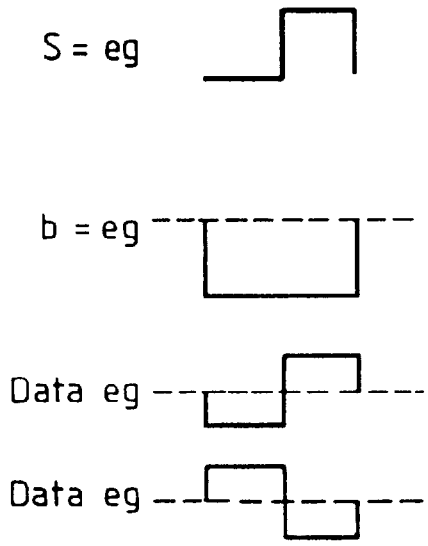
FIG. 9 is a diagram showing one arrangement of addressing sequence for a sixteen line display having a temporal weighting of 1:3 modified by blanking pulses to give a temporal weighing of 1:2 and a brightness level of 21/32.

FIG. 9 shows the addressing of 16 lines over 32 periods, the figure shows a snapshot over 32 periods. This would normally give a temporal weighting of 1:3 with both blanking pulses preceding the strobing pulse by the same minimum interval. Blanking pulses are arranged so that the temporal weighting is 1:2. As shown the strobing pulses are in the time ratio 8:24. ie 1:3. Taking the times indicated in FIG. 5. then FIG. 9 gives t1=10; t2=7; t3=1; t4=14. This gives the following greyscales:

TABLE 2

| | Level of white |
|---|---|
| bbbb - black for all 32 periods | 0 |
| bwbb - black for 25 and white for 7 periods | 7 |
| bbbw - black for 18 and white for 14 periods | 14 |
| bwbw - black for 11 and white for 21 periods | 21 |

This arrangement gives a maximum brightness of 21/32.

Clearly this can be extended for a 256 line display by arranging the 16 lines in groups of 16 and dividing each period up into 16 subperiods as explained earlier.

FIG. 10 shows the addressing of 16 lines in 32 time periods with strobing pulse S immediately preceded by blanking pulse b. The two periods where the display can be white are 20 time periods, and 10 time periods. The temporal weighting is thus 10:20 ie 1:2 which is an even weighting. The maximum brightness is 30/32. However, the effect of blanking just before strobing is to slow down switching of the liquid crystal material.

It is common to blank a few lines ahead of strobing; typically blanking is 4 to 7 lines ahead of strobing and reduces switching times. Taking the arrangement of FIG 10 and making the blanking occur 4 lines ahead of strobing results in a temporal weighting of 7:17 which is not an even weighting. The maximum brightness is 24/32.

FIG. 11 shows the addressing of 16 lines in 32 time periods. In every line one blanking pulse is 4 lines ahead of strobing, and the other blanking pulse is ahead of strobing by 7 lines. The display can be white for both 14 and 7 time periods, ie a temporal weighting of 7:14. which is an even weighting. Maximum brightness is 21/32.

Figure 12:
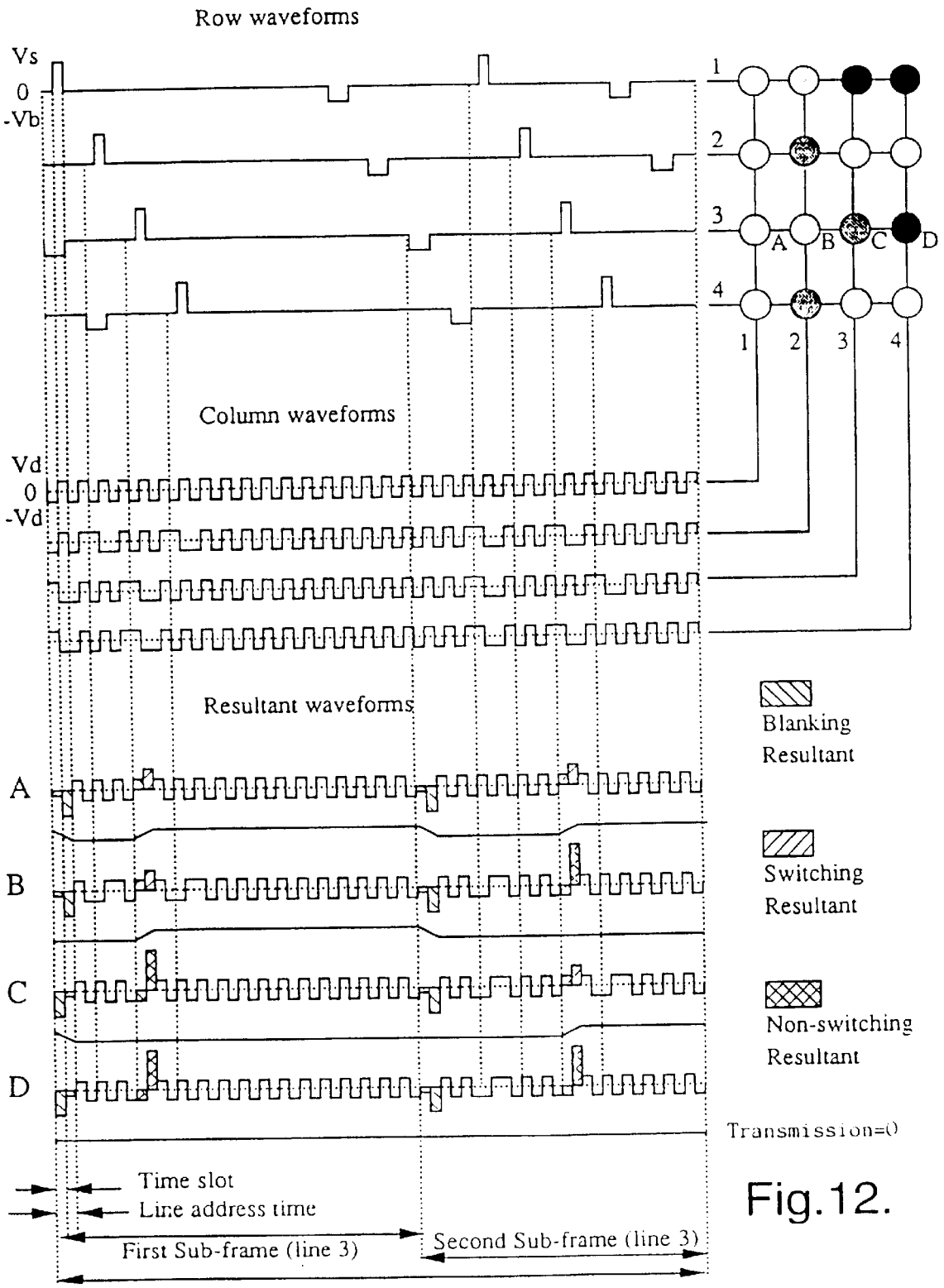
FIG. 12 shows waveforms for applying to lines and columns of a 16 line array showing four lines and four columns having four different grey scale levels.

Waveforms for addressing a 16 line 4 columns matrix with four levels of greyscale are shown in FIG. 12. Shown are 4 of the 16 lines and columns marked 1, 2, 3, 4, with each line and column intersection left unshaded, lightly shaded, darkly shaded, or completely black, to respectively indicate white, light grey, dark grey, and black. Line 3 is marked to show white, light grey, dark grey, and black in columns 1, 2, 3, 4 respectively. Waveforms applied to the lines (rows) are shown; they comprise blanking pulses −Vb, and strobe pulses +Vs, applied twice per frame time. Column waveforms are ±Vd pulses each pulse lasting one time slot (ts). The illustrated pattern of column waveforms provide the greyscale pattern of display shown. The resultant waveforms at pixels A, B, C, D, in line 3 are shown. Under each resultant is a graph showing light transmission through the associated pixel; pixel A shows the most time with a high transmission and is therefore the lightest, ie white, pixel. In contrast pixel D has zero transmission and is therefore black.

The addressing of a 16 line matrix can be expanded to 256 lines or more as described above by addressing lines: 1, 17, 33, 49–241; 7, 23, 39, 55–246; 2, 18, 34, 50–242. Increasing the number of columns does not affect the complexity.

One circuit for addressing a 16 or more line display is shown in FIG. 13; it modifies the line driver circuits of FIG. 1; no change is needed for the column driver. As shown in FIG. 13 four line drivers are used 20, 21, 22. 23. Line driver 20 has its successive outputs connected to lines 1, 5, 9, 13 etc; line driver 21 has its successive outputs connected to lines 2, 6, 10, 14; line driver 22 has its successive outputs connected to lines 3, 7, 11, 15, and line driver 23 has its successive outputs connected to lines 4, 8, 12, 16. This arrangement can be cascaded to use all driver outputs, eg the addressing of 256 lines by using 64 driver outputs.

In a modification, blanking pulses are replaced by strobes. This requires four subframes of addressing in order to obtain four different periods of switched states.

Explanation of spatial weighting.

A pixel can be divided up into a number of areas of equal or different sizes. The apparent darkness of a pixel is related to the area of black compared to the area of white. For example FIG. 14 shows a pixel divided into 2 areas in the ratio of 1:2 which could be arranged to be consecutive lines of a display. This allows 4 greyscale levels, ie both areas black, both areas white, the large area black with the other white, and the large area white and the other black. FIG. 15 shows a pixel subdivided into 4 areas in the ratio 1:2:2:4 which allows a total of 10 levels. This requires two adjacent lines and columns per pixel.

In high resolution displays the overall size of a pixel can be quite small eg 25×25 $\mu$m, subdividing the pixel can cause difficulties in manufacturing the smallest subpixel. This problem may be overcome by varying the apparent size of a subpixel. The apparent size of one subpixel relative to an adjacent subpixel is related both to the area of the subpixels, and to their relative brightness. Thus by making the smallest subpixel darker than its neighbour, then the smallest subpixel appears to be even smaller than its physical size would indicate. This allows the subpixel to made slightly larger in area than expected for a given greyscale level.

The greyscale level (and hence relative darkness) of one subpixel relative to another may be altered by varying the time between blanking and addressing pulses shown in FIG. 5, ie varying t1+t3 in adjacent lines. This varies the length of time spent in a black state in the different greyscale levels.

As described above, uniform greyscale levels in a display may be achieved by temporal weighting alone, or in combination with spatial weighting. Furthermore the spatial weighting may be modified to varying the apparent size of adjacent subpixels.

For example 256 greyscales may be provided by the following combinations:

TABLE 3

| Temporal Ratio | Spatial Ratio |
|---|---|
| 1:2 | 1:4:16:64 |
| 1:4 | 1:2:16:32 |
| 1:16 | 1:2:4:8 |

It may not be desirable to produce linearly spaced grey levels. The eye does not respond linearly to uniform increments of brightness, the apparent difference in lightness between adjacent levels being much less at the light end of the scale than at the dark end (R W G Hunt, Measuring Colour, second edition, published by Ellis Horwood Ltd. 1991).

A feature of the present invention, is that any desired weighting may be obtained by addressing the lines in the required (non-sequential) sequence and making correction to any small errors in the weighting by use of the variable blanking to strobe separation. The required addressing sequence, for a required temporal ratio of $r_1:r_2:r_3: \ldots :r_x$ (x is number of bits of greyscale). may be arrived at from the following algorithm which will be correct as M (the number of lines) approaches infinity;

$(1; r_2 + r_3 + \ldots + 3_x + 1;\quad r_3 + \ldots + r_x + 1; \ldots; r_x + 1)$ first bracket
$(2; r_2 + r_3 + \ldots + 3_x + 2;\quad r_3 + \ldots + r_x + 2; \ldots; r_x + 2)$ second bracket
$(3; r_2 + r_3 + \ldots + 3_x + 3;\quad r_3 + \ldots + r_x + 3; \ldots; r_x + 3)$ third bracket
.
.
.
$(R; r_2 + r_3 + \ldots + 3_x + R;\quad r_3 + \ldots + r_x + R; \ldots; r_x + R)$ Rth bracket Where R equal the summation of $r_i$ (for i=1 to x) and where the addressing sequence follows the first bracket for the first R lines, then that sequence is repeated on the next R lines until all (M/R) groups of lines have been addressed, then the addressing sequence follows the second bracket for all (M/R) groups of lines, and so on until the sequence has followed the $R^{th}$ bracket to all (M/R) groups of line; modulo R arithmetic is used to keep the numerical expression within the relevant group of R lines.

The actual temporal ratios will be given by:

$$((r_1xM/R)+1): ((r_2xM/R)+1): \ldots :((r_{x-1}xM/R)+1): ((r_xxM/R)-(x-1))$$

For example consider a desired temporal ratio of 1:2:4 and a total of 14 lines. Then $r_1=1$, $r_2=2$, and $r_3=4$, ($r_x=r_3=4$), x=3 the number of temporal bits, R=1+2+4=7, and M=14.

The addressing sequence of lines is:

| | first group of R lines | second group of R lines |
|---|---|---|
| first bracket | $1, r_2 + r_3 + 1, r_3 + 1$ | $7 + 1, 7 + r_2 + r_3 + 1, 7 + r_3 + 1$ |

Substituting values this becomes:

| | | |
|---|---|---|
| first bracket | 1. 2 + 4 + 1, 4 + 1 | 7 + 1, 7 + 2 + 4 + 1, 7 + 4 + 1 |
| second bracket | 2. 2 + 4 + 2, 4 + 2 | 7 + 2, 7 + 2 + 4 + 2, 7 + 4 + 2 |
| third bracket | 3. 2 + 4 + 3, 4 + 3 | 7 + 3, 7 + 2 + 4 + 3, 7 + 4 + 3 |
| fourth bracket | 4. 2 + 4 + 4, 4 + 4 | 7 + 4, 7 + 2 + 4 + 4, 7 + 4 + 4 |
| fifth bracket | 5. 2 + 4 + 5, 4 + 5 | 7 + 5, 7 + 2 + 4 + 5, 7 + 4 + 5 |
| sixth bracket | 6. 2 + 4 + 6. 4 + 6 | 7 + 6, 7 + 2 + 4 + 6, 7 + 4 + 6 |
| seventh bracket | 7. 2 + 4 + 7. 4 + 7 | 7 + 7, 7 + 2 + 4 + 7, 7 + 4 + 7 |

This gives the following sequence of addressing, showing the modulo conversion thus (x>)x−7:

| | first group of R lines | second group of R lines |
|---|---|---|
| first bracket | 1. 7, 5, | 8. 14, 12 |
| second bracket | 2. (8>) 1, 6 | 9. (15>) 8, 13 |
| third bracket | 3. (9>) 2, 7 | 10. (16>) 9, 14 |
| fourth bracket | 4. (10>) 3, (8>) 1 | 11. (17>) 10, (15>) 8 |
| fifth bracket | 5. (11>) 4, (9>) 2 | 12. (18>) 11, (16>) 9 |
| sixth bracket | 6. (12>) 5, (10>) 3 | 13. (19>) 12, (17>) 10 |
| seventh bracket | 7. (13>) 6, (11>) 4 | 14. (20>) 13, (18>) 11 |

The temporal ratio is 7:13:22 which is 1:1.86:3.14. This addressing sequence is illustrated in FIG. 16, where the solid squares represent addressing, ie blanking followed by strobe.

The actual temporal ratio will be given by:

$$\{1\times3\times14\}+7:(2\times3\times14)+7:(4\times3\times14)-(3-1)7$$

ie 49:91:154 which is 1:1.86:3.14.

We claim:

1. A method of multiplex addressing a bistable liquid crystal display formed by the intersections of an m set of electrodes and an n set of electrodes across a layer of smectic liquid crystal material to provide an mxn matrix of addressable pixels comprising the steps of:

generating m and n waveforms for applying to the m, n electrodes, such waveforms comprising voltage pulses of various dc amplitude and sign;

applying an m-waveform to each electrode in the m set of electrodes in a sequence whilst applying appropriate one of two n-waveforms to the n set of electrodes to address each pixel along a given m electrode into a required state;

addressing each pixel at least two times in a given frame time, the addressing being by application of a blanking waveform followed or preceded by a strobe waveform in combination with one of two data waveforms, the time between application of blanking and strobe being an addressing time; and varying the addressing time and relative times of addressing each pixel within the frame time to provide a required greyscale intensity interval between different greyscale levels.

2. The method of claim 1 wherein the blanking waveform is replaced by a strobe pulse in combination with two data waveforms.

3. The method of claim 1 wherein the pixels are complete pixels.

4. The method of claim 1 wherein the pixels are formed by combinations of two or more subpixels of the same or different size.

5. The method of claim 4 wherein the relative intensities per unit area between adjacent subpixels is different.

6. The method of claim 1 wherein the addressing sequence of electrodes 1 to M is given by:

$(1;\ r_2+r_3+\ldots+r_x+1;\ r_3+\ldots+r_x+1;\ \ldots;\ r_x+1)$ for electrodes R.y+(1 to R) (y=0, 1, 2, 3, . . . (M/R)−1);

$(2;\ r_2+r_3+\ldots+r_x+2;\ r_3+\ldots+r_x+2;\ \ldots;\ r_x2)$ for electrodes 1+[R.y+(1 to R)] (y=0, 1, 2, 3, . . . , (M/R)−1);

$(3;\ r_2+r_3+\ldots+r_x+3;\ r_3+\ldots+r_x3;\ \ldots;\ r_x+3)$ for electrodes 2+R.y+(1 to R) (y=0, 1, 2, 3, . . . , (M/R)−1);

$(R;\ r_2+r_3+\ldots+r_x+R;\ r_3+\ldots+r_x+R;\ \ldots;\ r_x+R)$ for electrodes R y+(1 to R) (y=0, 1, 2, 3, . . . (M/R)−1)

where $r_1$; $r_2$; $r_3$; . . . ; $r_x$ (x is number of bits of greyscale), R equal the summation of $r_i$ (for i=1 to x).

7. A multiplex addressed liquid crystal display comprising:

a liquid crystal cell including a layer of ferroelectric smectic liquid crystal material contained between two walls, an m set of electrodes on one wall and an n set of electrodes on the other wall arranged to form collectively an m,n matrix of addressable pixels:

waveform generators for generating m and n waveforms comprising voltage pulses of various dc amplitude and sign in successive time slots (ts) and applying the waveforms to the m and n sets of electrodes through driver circuits;

means for controlling the application of m and n waveforms so that a desired display pattern is obtained;

means for addressing each pixel a first time and a second or more times in a given frame time, the addressing being by application of a blanking waveform followed or preceded by a strobe waveform in combination with one of two data waveforms, the time between application of blanking and strobe being an addressing time; and varying the addressing time and relative times of addressing each pixel within the frame time to provide a required greyscale intensity interval between different greyscale levels.

8. A multiplex addressed liquid crystal display comprising:

a liquid crystal cell including a layer of ferroelectric smectic liquid crystal material contained between two walls, an m set of electrodes on one wall and an n set of electrodes on the other wall arranged to form collectively an m,n matrix of addressable pixels:

waveform generators for generating m and n waveforms comprising voltage pulses of various dc amplitude and sign in successive time slots (ts), applying the waveforms to the m and n sets of electrodes through driver circuits, controlling the application of m and n waveforms so that a desired display pattern is obtained and addressing each pixel a first time and a second or more times in a given frame time, said addressing by application of a blanking waveform followed or preceded by a strobe waveform in combination with one of two data waveforms, the time between application of blanking and strobe waveforms comprising an addressing time, and varying the addressing time and relative times of addressing each pixel within the frame time to provide a required greyscale intensity interval between different greyscale levels.

* * * * *